United States Patent [19]

Titzer

[11] Patent Number: 4,489,903

[45] Date of Patent: Dec. 25, 1984

[54] STACK CREELING SYSTEM AND METHOD OF CONTINUOUSLY CREELING YARN

[75] Inventor: Robert A. Titzer, Greensboro, N.C.

[73] Assignee: Burlington Industries, Inc., Greensboro, N.C.

[21] Appl. No.: 435,402

[22] Filed: Oct. 20, 1982

[51] Int. Cl.[3] ..... B65H 49/02

[52] U.S. Cl. ..... 242/131

[58] Field of Search ..... 242/131, 131.1, 129.5, 242/54 R, 129.62; 182/178; 280/79.2, 79.3; 211/23, 24, 59

[56] References Cited

U.S. PATENT DOCUMENTS

| | | | |
|---|---|---|---|
| 1,275,850 | 8/1918 | Colman | 242/131 |
| 1,864,558 | 6/1932 | Seeley | 242/45 X |
| 2,833,421 | 5/1958 | Skubic | 211/194 |
| 3,015,147 | 1/1962 | Croxton et al. | 28/28 |
| 3,053,558 | 9/1962 | Challas, Jr. et al. | 211/194 X |
| 3,321,153 | 5/1967 | Bryan, Jr. | 242/131 |
| 3,371,878 | 3/1968 | Garner | 242/45 |
| 3,966,221 | 6/1976 | Beam et al. | 280/79.3 |
| 4,019,700 | 4/1977 | King | 242/131.1 |

*Primary Examiner*—Leonard D. Christian

*Attorney, Agent, or Firm*—Cushman, Darby & Cushman

[57] ABSTRACT

A stack creeling system for the continuous creeling of yarn from a supply of yarn includes at least two rows of creeling units wherein each creeling unit includes at least two discrete creel frames, the creel frames support the yarn supply for rotatably unwinding the yarn therefrom. The method of continuously creeling yarn from the yarn supplies includes creeling yarn from one row, securing the free end of the yarns from the other row to the captured ends of the yarn supplies in the one row and permitting the yarn supplies for the one row to be expended, wherein thereafter the yarn supplies are replenished and the method repeated to alternately creel yarn from the one and other rows to effect a continuous creeling operation.

17 Claims, 6 Drawing Figures

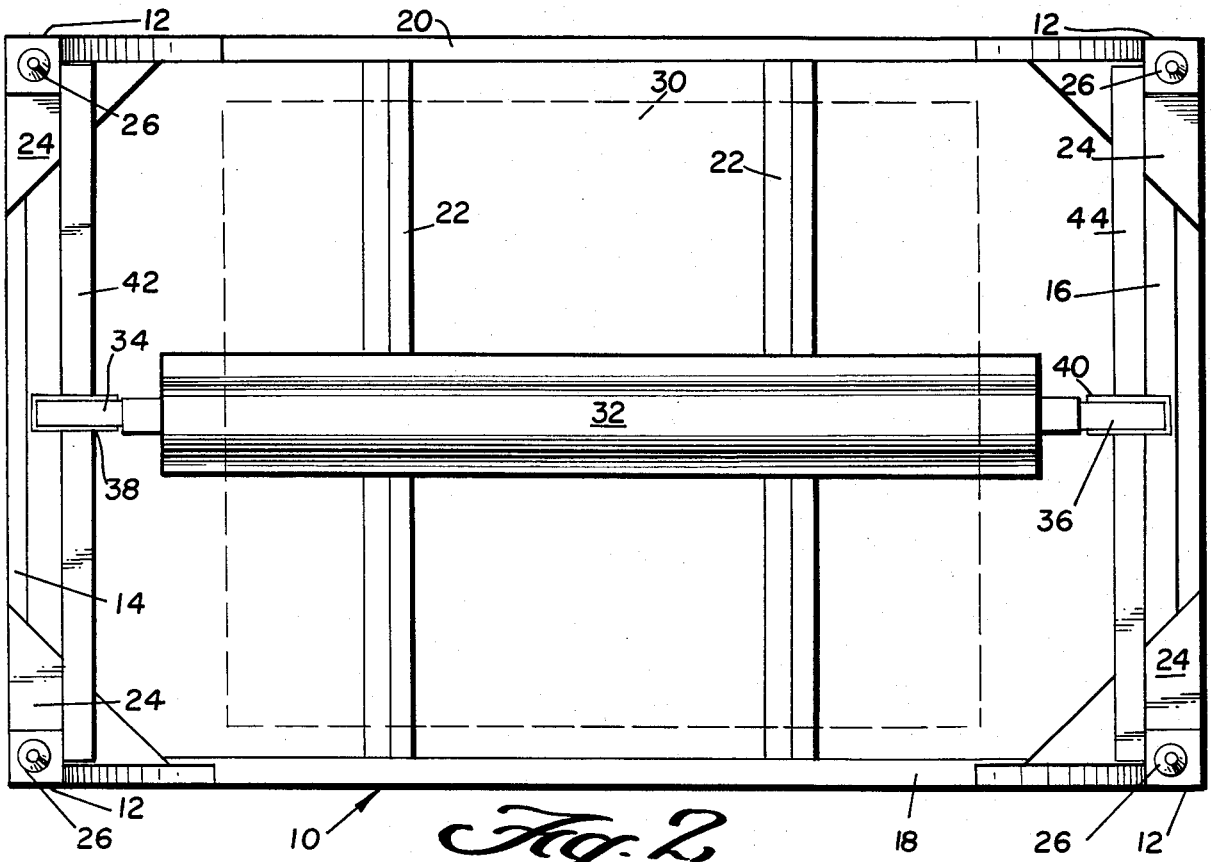
Fig. 2
Fig. 1
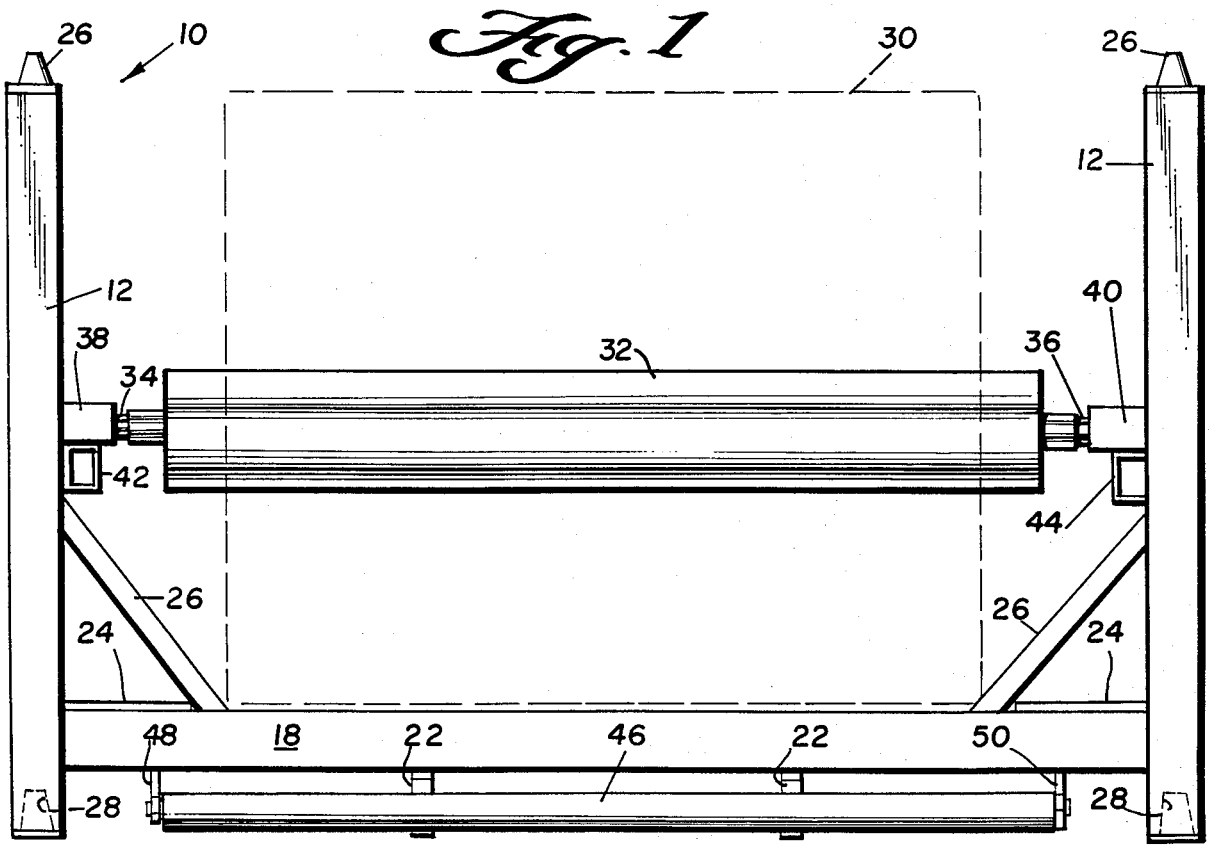

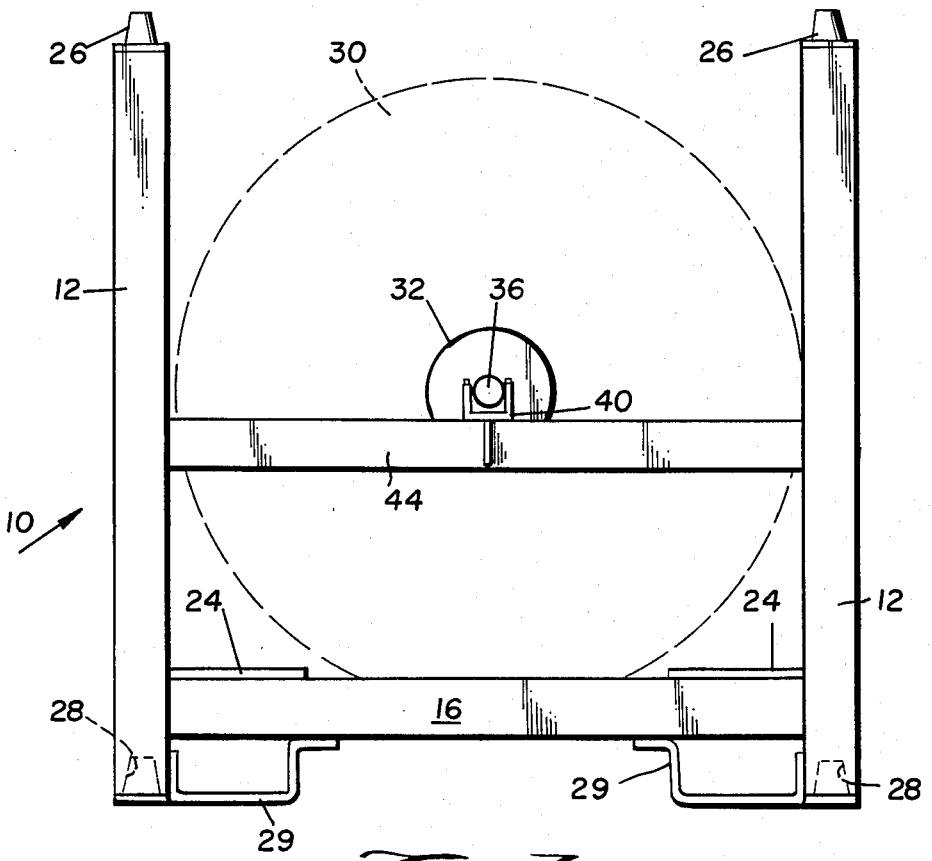
Fig. 3
Fig. 4
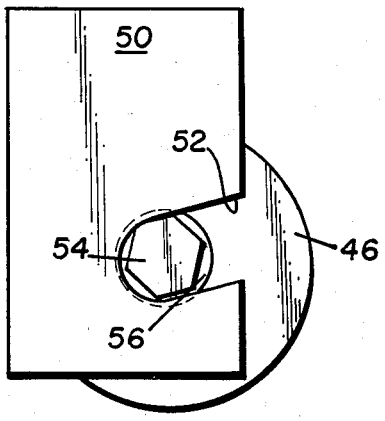

STACK CREELING SYSTEM AND METHOD OF CONTINUOUSLY CREELING YARN

INTRODUCTION

The present invention generally relates to a novel method and device for creeling yarns to permit dyeing on a continuous basis having maximum safety for the operators and utilizing a minimum amount of mill floor space. The present invention, besides being advantageous for continuous dyeing applications, may also be conceivably utilized in any creeling application where yarns or other like materials are intended to be continuously fed into a yarn treating device.

The present invention is particularly advantageous in creeling applications utilizing a spool of yarn conventionally referred to in the art as a "ball warp". Such ball warps are extremely heavy, weighing in the range of 900 to about 1700 pounds, and thus, require mechanical assistance when a fresh supply of yarn is necessary to replenish a spent spool.

Ball warps are a conventional means for storing yarns in an organized fashion prior to treatment. Ball warps traditionally comprise an elongated cylindrical spool core element about which a continuous length of yarn is wound. The yarn, of course, has two ends, one of which is captured against the core element when the yarn is wound therearound (hereinafter "captured end") and the other of which is substantially free (hereinafter "free end") on the exterior surface of the ball warp after the yarn has been wound around the core element to establish a predetermined cross-sectional diameter of the wound yarn. When the ball warp is placed in a creeling position, the yarn, of course, is unwound and fed to the dye bath beginning with the free end. Thus, the ball warp will decrease in cross-sectional diameter and will be completely spent after the captured end leaves the spool.

THE PRIOR ART

Creeling frames, in and of themselves, are fairly well known to those in the art as evidenced by U.S. Pat. Nos. 4,019,700; 3,015,147; 3,321,153; 1,275,850 and 1,864,558.

In dyeing operations it is often required to have 24 or 36 ball warps simultaneously being creeled or fed into a dye bath having a predetermined dye range (e.g., a predetermined color hue). It is extremely important to maintain feeding continuity of the yarn as it is treated in the dye bath since such yarns after being dyed will be further processed into textile products downstream thereof. Thus, to achieve product uniformity and maintain continuity of operation, the captured end of yarn comprising a ball warp being fed into the dye bath (hereinafter "creeling ball warp") is typically tied or otherwise secured to the free end of a full ball warp (hereinafter "reserve ball warp") having a fresh supply of yarn. Thus, when the yarn on the creeling ball warp is expended, the yarn on the reserve ball warp beings to be unwound and fed into the dye bath thereby establishing it at such time as the creeling ball warp. This cycle is then repeated to create continuity of operation.

Generally, there exists two methods in the industry for establishing creeling continuity of ball warps. In one such known method, a creeling ball warp is placed either manually or with mechanical assistance (e.g., a jack) into the lower position of a fixed two-position creeling stand. When the creeling ball warp's cross-sectional diameter has decreased to about 10", it is manually lifted to the higher position on the creeling stand. After all ball warps (for example, the 36 ball warps) have been manually lifted to the higher position, reserve ball warps are placed into the lower position before the creeling ball warp has completely unwound. The free end of the reserve ball warp is then tied to the captured end of the creeling ball warp just before the yarn on the latter is expanded. Thereafter, the cycle repeats itself.

In a second known method, the creeling and reserve warps are positioned in a fixed horizontal frame arranged in the feeding direction. Similar to the above method, the free end of the reserve ball warp is tied with the captured end of the creeling ball warp. After the creeling ball warp is expended the reserve ball warp then becomes the creeling ball warp and a new reserve ball warp is positioned, the free end thereof being tied to the captured end of the creeling warp. Once again the procedure is repeated to maintain continuity of operation.

The above known methods, however, are disadvantageous in several respects. For example, in both methods, a special handling system (e.g., overhead hoist and rail system) is necessary in order to transfer the ball warps from the storage area to the fixed creeling frames. Additionally, since the ends of the creeling and reserve ball warps can only be tied together at selected times, significant additional manpower is needed to attend to such tasks, especially if 36 ball warps are continuously being unwound. Finally, the latter known method, since the ball warps are horizontally arranged, demands a significant amount of floor space in the mill. Accordingly, improved means have been necessary to alleviate such disadvantages.

SUMMARY OF THE INVENTION

According to the present invention, a significant advance in continuous creeling methods has been discovered which overcomes the above-described prior art disadvantages. The present invention utilizes for each ball warp a discrete creeling frame which supports the ball warp to enable the yarn thereof to be unwound and fed to a dye bath, for example. The individual creeling frames are vertically stackable with one another. It is presently contemplated that at least two creeling frames will be vertically stacked to form a unit and that a plurality of such units will be arranged in at least two organized substantially parallel rows. One of the rows will comprise the creeling ball warps (hereinafter "creeling row") wile the other row will comprise the reserve ball warps (hereinafter "reserve row").

At a preselected time, the free ends of each ball warp in the reserve row will be tied or otherwise secured to the captured ends of a respective one of the ball warps in the creeling row. That is, the ball warp occupying the upper position in a unit in the reserve row will have its free end secured to the captured end of a ball warp occupying the upper position in a unit in the creeling row directly opposite to it. Similarly, a ball warp in the lower position of a unit in the reserve row will be secured to a respective lower ball warp in a unit in the creeling row directly opposite to it. In such a manner, the ball warps in the creeling row will all be unwound at about the same period of time, and thus, the reserve row at such time will then become the creeling row. Thereafter, all the expended ball warps in what was previously the creeling row will be replaced by additional frames having full ball warps therein and, thus, will then become the reserve row. The procedure is thereafter repeated to create continuity of operation.

The creeling frames can be utilized to store ball warps prior to being placed in a creeling position and, thus, can be vertically stacked so as to minimize mill floor space. Thereafter, when it is necessary to replenish the row(s) which contain expended ball warps, the individual creeling frames can be conveniently transferred from storage to a predetermined position in the row by a forklift truck or other suitable lifting devices. Thus, an entire row of expended ball warps can be replaced merely by removing the empty creeling frames and replacing them with creeling frames having full ball warps already positioned therein.

The reader may recognize further advantages of the present invention after careful consideration is given to the detailed description of the preferred exemplary embodiment thereof which follows.

BRIEF DESCRIPTION OF THE ACCOMPANYING DRAWINGS

Reference will hereinafter be made to the accompanying drawings, wherein like numerals throughout the various figures denote like structural elements, and wherein:

FIG. 1 is a front elevational view of a creeling frame in accordance with the present invention;

FIG. 2 is a top plan view of the creeling frame depicted in FIG. 1;

FIG. 3 is a side elevational view of the creeling frame depicted in FIG. 1;

FIG. 4 is a detailed side elevational view of an auxiliary roller utilized with the creeling frame depicted in FIG. 1;

DETAILED DESCRIPTION OF THE PREFERRED EXEMPLARY EMBODIMENTS

Figure 5:
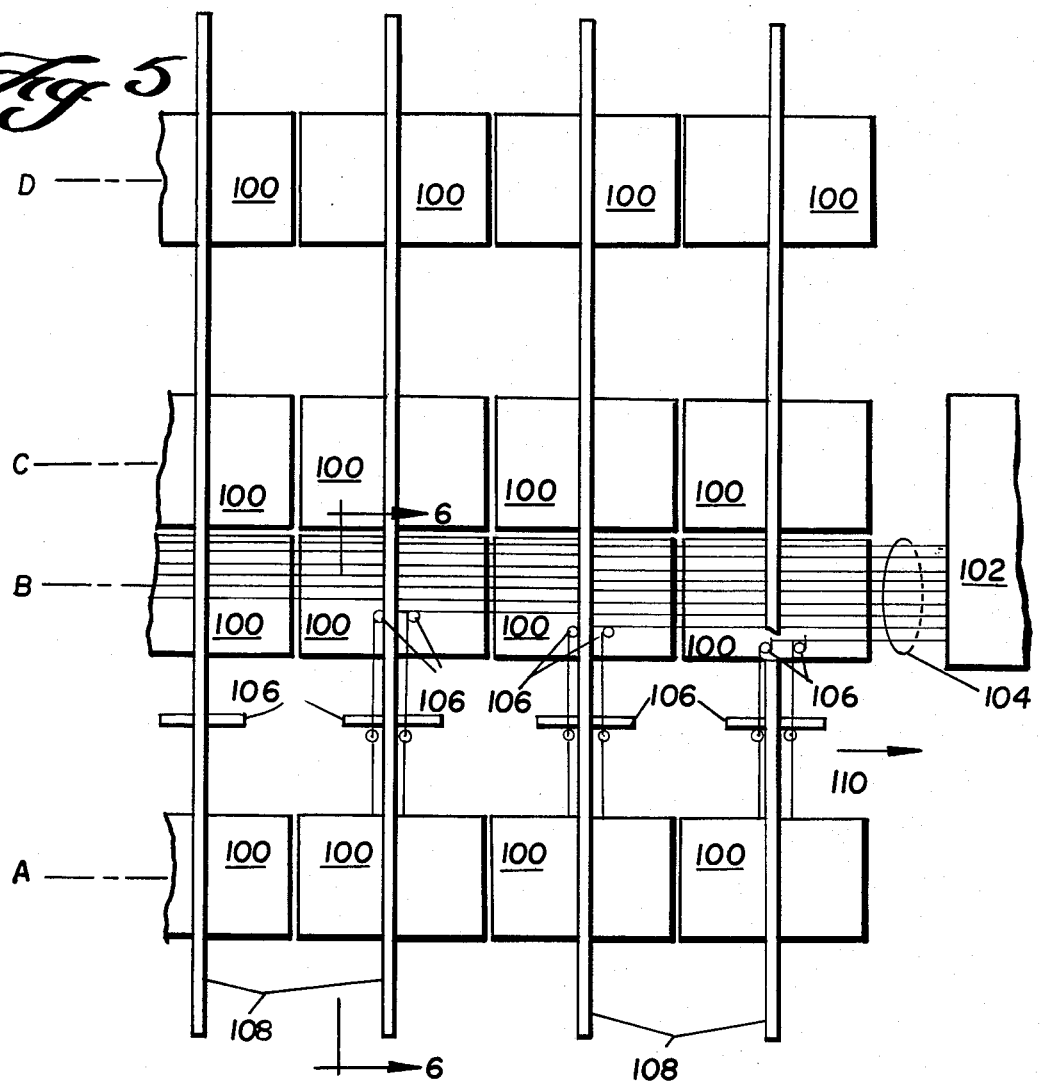
FIG. 5 is a schematic floor plan view of a preferred arrangement of creeling frames.

Reference will be made to accompanying FIGS. 1-3 wherein a preferred embodiment of a stackable creeling frame 10 in accordance with the present invention is depicted. Frame 10 generally comprises four vertically positioned post members 12 which form the four corners of frame 10. Post members 12 are separated from one another by an opposing pair of side supports 14, 16 and opposing front and rear supports 18, 20, respectively. Intermediate supports 22 as well as corner support plates 24 and corner braces 26 can be provided as desired to establish sufficient structural rigidity for frame 10.

Each post 12 includes structures to permit frame 10 to be vertically stackable with similar frames 10. To effect such stackable unity, I prefer to utilize male members 26 on the upper ends of posts 12 which can be received by female members 28 defined in posts 12 of a like frame 10. In such a manner, frame 10 can be stackable with similar frames 10 to establish a stacked unit thereof. It should be appreciated that male members 26 and female member 28 can be reverse of that shown in the accompanying drawings. However, it is presently preferred to have female members 28 defined in the lower end of posts 12 as this arrangement defines a substantially flat floor-engaging surface and thus renders the frame 10 more stable.

To faciliate movement of frame 10 by a forklift truck, for example, I prefer to provide frame 10 with a fixed pair of fork-receiving structures 29 rigidly secured to frames 16 and 18 (see FIG. 3). Other structures can be provided depending upon the means utilized for moving and stacking frames 10.

Frame 10 is dimensioned so as to support a ball warp 30 therein without interfering with other ball warps 30 in similar frames 10 when in a stacked relationship with one another. Ball warp 30 typically comprises a continuous length of yarn wound around a core element 32 which includes opposing shafts 34, 36. Shafts 34, 36 are journally supported by channel members 38, 40, fixed to frame 10 by cross-supports 42, 44, respectively, so as to permit core element 32 to rotate and thus unwind the yarn comprising ball warp 30 during creeling operation. Additionally, channel members 38, 40 permit core element 32 from which yarn has been expended to be conveniently and easily replaced with another core element 32 having its full complement of yarn wound therearound.

In order to prevent the yarn which is being unwound from a ball warp in a bottom position in a unit comprising at least two vertically stacked frames from rubbing against a portion of the upper frame in the stacked unit (see FIG. 6), I prefer to utilize an auxiliary roller 46 which is removably received in roller supports 48, 50 fixed to the bottom of front support 18. Each support 48, 50 defines an aperture 52 which is preferably upwardly inclined so as to accept the ends of the roller shaft 54 therein (see FIG. 4). Roller 46 is journalled to shaft 54 by suitable bearings 56. Thus, shaft 54 is restrained in aperture 52 yet roller 46 is permitted to rotate by virtue of bearings 56. A suitable type of roller 46 for use in combination with the present invention can be any standard conveyor roller which is commercially available.

It is preferred that roller 46 be removable since it will only be necessary to utilize it on the frame 10 in the upper position(s) of the stackable unit for reasons which will become more clear from the discussion which follows. It is presently preferred that the roller supports 48, 50 be rigidly coupled with each frame 10 since such an arrangement would promote complete interchangeability of the rollers and would reduce the costs thereof since all frames in a stackable unit (e.g., the bottom frames) would not require an auxiliary roller 46. Those in the art, howver, may wish to integrally provide each of the frames 10 with an auxiliary roller 46, if desired.

Figure 6:
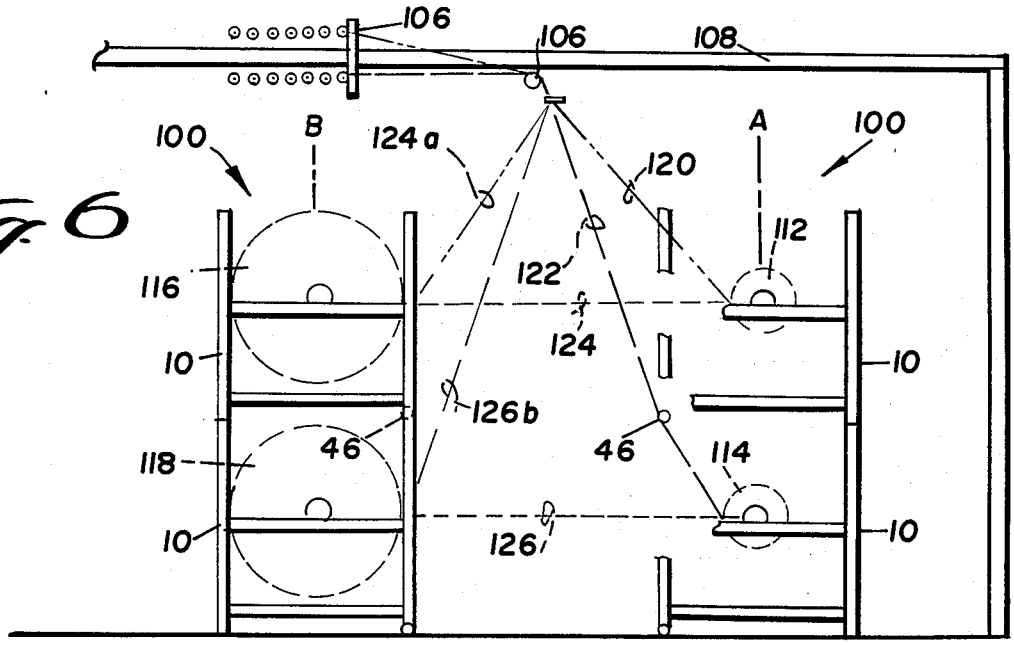
FIG. 6 is a schematic partial elevational view of the floor plan arrangement taken along line 6—6 in FIG. 5.

The preferred method of creeling ball warps in accordance with the present invention will now be described with particular attention being directed to accompanying FIGS. 5 and 6. As shown therein, the individual creeling frames 10 are vertically stackable to form units 100 (see FIG. 6). Preferably, at least two frames 10 are vertically stacked but additional numbers of frames can be stacked together as desired, the only limitation being the amount of available vertical space and the additional difficulties which may be encountered during stacking operations (e.g., the vertical lifting capabilities of the forklift truck, etc.). Units 100 are postiioned into rows (four rows designated A, B, C, and D are shown in FIGS. 5 and 6) upstream of the textile treating unit (e.g., dye bath 102). Yarns 104 which are unwound from respective ones of the ball warps are directed to dye bath 102 by suitable rollers 106 rotatably supported by overhead beams 108.

Preferably, units 100 are arranged in rows so that the longitudinal dimension of frames 10 correspond to the direction (arrow 110) of feeding yarns 104 to dye bath 102. Of course, other arrangements of the rows can be utilized with appropriate modification of the placement of rollers 106.

According to the present invention, at least two opposing rows (e.g., rows A, B and/or rows C, D) are utilized to effect continuity of feeding. Attention is directed to FIG. 6 wherein row A is depicted as containing units 100 which support at least upper and lower creeling ball warps 112, 114, respectively, and is thus designated the "creeling row", while row B is depicted as containing units 100 which support at least upper and lower reserve ball warps 116, 118, respectively, and is thus designated the "reserve row" for purposes of description.

The yarn 120, 122 on ball warps 112, 114, respectively, is continuously unwound therefrom and conveyed to dye bath 102 by suitable driving means (not shown) acting upon the yarns. When the diameter of ball warps 112, 114 has decreased a sufficient amount (e.g., prior to the yarn 120, 122 being completely expended from ball warps 112, 114, respectively), the free end of upper reserve ball warp 116 is tied or otherwise secured to the captured end of upper creeling ball warp 112 as shown by line 124 in FIG. 6. In a similar manner, the free end of lower reserve ball warp 118 is secured to the captured end of lower ball warp 114 as shown by line 126 in FIG. 6. The yarn 120, 122 will be expended from creeling ball warps 112, 114 at about the same time and thus continuous feeding of dye bath 102 will be effected by virtue of the yarn then being unwound at such time from reserve ball warps 116, 118 as depicted by lines 124A and 126B in FIG. 6. Of course, at such time reserve ball warps 116, 118 will then become the creeling ball warps for the system and thus row B will then be the creeling row. Auxiliary rollers 46 by virtue of their removeable placement in units 100 can be transferred across the aisle to a respective unit 100 in the opposite row.

The empty frames 10 of row A can be removed and other frames 10 having full ball warps can be stackably positioned so as to create a reserve row of ball warps. In a similar manner to that described above, the free ends of reserve ball warps (now in row A) are tied to respective captured ends of creeling ball warps (now in row B). The method is repetitive so that in such a manner, rows A and B will alternately become creeling and reserve rows as the method to effect continuous creeling operation progresses.

While only rows A and B have been described in operation, it should be appreciated that such description is similarly applicable to rows C and D. Also, while only four rows are depicted in the accompanying drawings, it should be appreciated that as many paired rows as is practicable or desirable can be satisfactorily utilized.

Thus, while the present invention has been herein described in what is presently conceived to be the most preferred embodiment thereof, those in the art may appreciate after careful consideration is given to the above disclosure that many modifications may be made, which modifications shall be accorded the broadest scope of the appended claims so as to encompass all equivalent structures, devices, methods or processes.

What I claim is:

1. A method of continuously creeling yarn from a supply of yarn wound around a rotatable yarn support, said yarn supply having a captured end near said support and a free end, said method comprising the steps of:

(a) selecting a predetermined plurality of said yarn supplies each supported for rotatable movement in a frame, said frame including means permitting said frame to be vertically stacked with a predetermined number of similar ones of said frame;

(b) vertically stacking at least two of said frames to form a plurality of stacked units each of said stacked units including at least an upper frame supporting an upper yarn supply and a lower frame supporting a lower yarn supply;

(c) arranging said stacked units in at least two substantially parallel rows;

(d) creeling yarn from said upper and lower yarn supplies of said units comprising one of said rows by unwinding said yarn in a direction from said free end to said captured end;

(e) connecting the free end of the upper yarn supplies in said other row with the captured end of a corresponding opposing one of said upper yarn supplies in said one row;

(f) connecting the free end of the lower yarn suplies in said other row with the captured end of a corresponding opposing one of said lower yarn supplies in said one row; and (g) permitting said yarn supplies of said one row to be expended thereby permitting creeling of said yarn supplies in said other row to effect continuous creeling of said yarn.

2. A method as in claim 1 further comprising after step (g), the steps of:

(h) resupplying the yarn supplies of said one row;

(i) connecting the free end of the upper yarn supplies in said one row with the captured end of a corresponding opposing one of said upper yarn supplies in said other row;

(j) connecting the free end of the lower yarn supplies in said one row with the captured end of a corresponding opposing one of said lower yarn supplies in said other row; and (k) permitting said yarn supplies of said other row to be expended thereby permitting creeling of said yarn supplies in said one row to effect continuous creeling of said yarn.

3. A method as in claim 2 wherein step (h) is practiced according to the steps of:

(1) removing the stacked units from said one row; and (2) positioning reserve stacked units comprising yarn supplies in said one row.

4. A method as in claim 2 or 3 wherein steps (h)–(k) are repeated so as to alternately effect creeling from said one and other rows.

5. A method as in claim 1, 2 or 3 further comprising the step of preventing the yarn being creeled from the yarn supplies in said lower frames of said one or other rows from rubbing against said upper frames of said one or said other rows.

6. A system of continuously creeling yarn from a plural supplies of yarn wound around a respective rotatable yarn support, each said yarn supply having a captured end near said support and a free end, said system comprising:

a plurality of units arranged in at least first and second substantially parallel rows, each of said units comprising at least upper and lower vertically stacked upper and lower creel frame means each for supporting a respective one of said plural yarn supplies, each of said upper and lower creel frame means including (a) journal means for journally supporting said yarn supply for rotatable movement therewith and for permitting removable placement of said yarn supply with said frame means, and (b) means permitting vertical stackable unity between said upper and lower frame means, wherein each free end of a yarn supply supported in an upper creel frame means of said first row is connected to a captured end of a yarn supply supported in a corresponding opposing one of an upper creel frame means of said second row; and wherein each free end of a yarn supply supported in a lower creel frame means of said first row is connected to a captured end of a yarn supply supported in a corresponding opposing one of a lower creel frame means of said second row;

whereby upon exhaust of said yarn supplies of said second row upon creeling thereof, the yarn from said yarn supplies of said first row is then creeled by virtue of the connection of said free and captured ends between opposing yarn supplies of said first and second rows.

7. A system as in claim 6 wherein at least said upper frame means includes roller means including mounting means to rotatably mount said roller means to the lower front portion of said upper frame means, said roller means for preventing the yarn of said yarn supply in said lower frame means from rubbing against said upper frame means wherein said mounting means permits said roller means to be interchangeably moved between said upper frame means of said first and second rows.

8. A system as in claim 6 or 7 wherein each of said upper and lower frame means comprises front and rear pairs of opposing vertical support posts and support means rigidly separating said support posts, said yarn supply being substantially centrally placeable relative said support posts.

9. A system as in claim 8 wherein said means permitting stackable unity comprises male members formed on the upper end of predetermined ones of said support posts and means defining a cavity formed in the lower end of corresponding predetermined ones of said support posts, said cavity defining means for accepting one of said male members of said lower frame means therein to establish stackable unity between said upper and lower frame means.

10. A vertically stackable creel frame comprising:

frame means for supporting a supply of yarn;

means associated with said frame means for journally supporting said yarn supply and for permitting removable placement of said yarn supply with said frame means; and means permitting vertical stackable unity between said frame means and other similar ones of said frame means and including male member means formed on one end of said front and rear support posts and means defining a cavity formed in the other end of said front and rear support posts, said male member means of said frame means being receivable in said cavity defining means of a similar one of said frame means so as to establish vertical stackable unity between said frame means and said similar one;

roller means for preventing yarn from a yarn supply of a similar frame means inferiorly stacked with respect to said first mentioned frame means from rubbing against said first mentioned frame means; and mounting means to removably mount said roller means to said first mentioned frame means to permit said roller means to be removably transferred to similar ones of said frame means.

11. A creel frame as in claim 10 wherein said frame means includes a front pair of rigidly spaced apart vertical support posts;

a rear pair of rigidly spaced apart vertical support posts; and support means rigidly and opposingly separating said front and rear pairs of support posts.

12. A creel frame as in claim 10 or 11 further comprising roller means rotatably mounted to said frame means for preventing yarn from contacting said frame means.

13. A creel frame as in claim 12 wherein said roller means is removably mounted to said frame means.

14. A creeling unit comprising a plurality of vertically stacked creel frames as in claim 10 or 11.

15. A creel frame as in claim 10 wherein said mounting means includes a pair of spaced-apart roller supports fixed to said frame means to support said roller means therebetween, each said roller support including an open-ended aperture to receive a respective end of said roller means.

16. A creel frame as in claim 15 wherein each end of said roller means includes means defining parallel surfaces and wherein said aperture is at least partially defined by parallel edges, said edges cooperating with said surfaces to removably mount said roller means to said roller supports.

17. A method as in claim 5 wherein said step of preventing the yarn being creeled from the yarn supplies in said lower frames from rubbing against said upper frames is practiced utilizing a removable roller, said roller being transferred between said one and other rows in dependence upon which row is being creeled.

* * * * *